US010912694B1

(12) United States Patent
Baksh

(10) Patent No.: US 10,912,694 B1
(45) Date of Patent: Feb. 9, 2021

(54) VENTILATION SYSTEM

(71) Applicant: Ed Baksh, South Plainfield, NJ (US)

(72) Inventor: Ed Baksh, South Plainfield, NJ (US)

( * ) Notice: Subject to any disclaimer, the term of this patent is extended or adjusted under 35 U.S.C. 154(b) by 181 days.

(21) Appl. No.: 15/782,899

(22) Filed: Oct. 13, 2017

(51) Int. Cl.
*A61G 7/057* (2006.01)
*A47C 21/04* (2006.01)
*A47C 31/00* (2006.01)

(52) U.S. Cl.
CPC ..... *A61G 7/05784* (2016.11); *A47C 21/044* (2013.01); *A47C 31/005* (2013.01); *A47C 31/008* (2013.01); *A61G 2210/70* (2013.01)

(58) Field of Classification Search
CPC ..... A47C 31/005; A47C 21/04; A47C 21/042; A47C 21/044; A61G 7/05784; A61G 7/05792; A61G 2210/70; F16L 45/00; F24F 13/029; F24F 13/04; D06F 58/22; A47G 9/007
See application file for complete search history.

(56) References Cited

U.S. PATENT DOCUMENTS 3,101,488 A 8/1963 Peebles
4,391,009 A 7/1983 Schild et al.
5,539,942 A * 7/1996 Melou ..... A61G 7/05776 5/655.3
5,890,245 A 4/1999 Klearman et al.
6,615,427 B1 9/2003 Hailey
7,631,377 B1 12/2009 Sanford
7,913,332 B1 3/2011 Barnhart
8,353,069 B1 * 1/2013 Miller ..... A47C 21/048 5/421
8,914,922 B1 * 12/2014 Wells ..... A61G 13/009 5/423
2007/0033733 A1 * 2/2007 Jen ..... A47C 7/74 5/423
2011/0221242 A1 9/2011 Juric
2012/0017371 A1 1/2012 Pollard
2014/0201910 A1 * 7/2014 Rand ..... A47C 21/044 5/423
2015/0121621 A1 * 5/2015 Aramli ..... A47C 21/048 5/423

(Continued)

OTHER PUBLICATIONS

MR and RLL Installation Guide [PDF]. Systemair, Jan. 2001 [retrieved on Aug. 13, 2019]. Retrieved from the Internet: <URL: https://www.systemair.com/globalassets/documentation/11061.pdf?filename=6267-MR+RLL+IMO.pdf> p. 1 (Year: 2001).*

(Continued)

*Primary Examiner* — Robert G Santos
*Assistant Examiner* — Alison N Labarge
(74) *Attorney, Agent, or Firm* — Cramer Patent & Design, PLLC; Aaron R. Cramer

(57) ABSTRACT

A ventilation system includes a plurality of air tubes within the sheet all of which are interconnected to a manifold. The topside surface of the air tubes comprises a plurality of nozzles which communicate with the outside environment of the sheet. The sheet is configured to create a positive flow of air through each nozzle when the manifold is connected to the exhaust portion of a blower. The system also includes means for administering a scented material in the flow of air generated by the blower. The blower motor may be operated by remote control.

8 Claims, 5 Drawing Sheets

(56) References Cited

U.S. PATENT DOCUMENTS

2015/0282631 A1* 10/2015 Creamer ..... A47C 21/044
5/423

OTHER PUBLICATIONS

Leeson Product Catalog [PDF]. Steven Engineering, Mar. 2016 [retrieved Aug. 13, 2013]. Retrieved from the Internet: <URL: https://stevenengineering.com/Tech_Support/PDFs/LEESON-MAIN_HVAC-FAN-MOTORS.pdf> p. 208, under "Single Phase—TEAO-PSC Type—Resilient Base" under catalog No. 11267.0 (Year: 2016).*

Gibbon 151100-3 PVC Flexible Hose Kit, 3" [online]. Gibbon, Feb. 2016 [retrieved Aug. 13, 2019], Retrieved from Internet <URL: https://www.amazon.com/Gibbon-151100-3-Pvc-Flexible-Hose/dp/B01BNDP3FE> p. 1-3 (Year: 2016).*

* cited by examiner

VENTILATION SYSTEM

RELATED APPLICATIONS

Not Applicable

FIELD OF THE INVENTION

The present invention relates generally to the field of ventilation systems, and more specifically, those systems that are adapted for use with a bed.

BACKGROUND OF THE INVENTION

Patients who are ill and confined to bed as a result of an illness, disability or accident are faced with obstacles on a daily basis that most of us take for granted. Even the very act of just lying in bed can cause health problems such as bedsores, ulcerations, and the like. Many patients cannot turn over due to physical conditions, or due to equipment and monitors they may be hooked up to. These types of problems are very difficult to eliminate due to the immobility of the patient. The more immobile the patient is, the worse the problems become. Such bed sores are caused not just by the increased pressure associated with the contact by the patient's body with the mattress, but the increased temperature and lack of air circulation as well Similar problems exist for those who sleep in warm climates and constantly toss and turn due to sweating.

Accordingly, there exists a need for a means by which sleeping individuals can be cooled for comfort and health while in a bed. It is also a benefit to have such an invention be relatively unobtrusive, easily manipulated, and adjustable. The development of the powered ventilation system for a bed fulfills this need.

Various attempts have been made to solve problems found in bed ventilation system art. Among these are found in: U.S. Pat. No. 7,913,332 in the name of Barnhart; U.S. Pat. No. 6,615,427 in the name of Hailey, and U.S. Pat. No. 7,631,377 in the name of Sanford. These prior art references are representative of bed ventilation systems.

None of the above inventions and patents, taken either singly or in combination, is seen to describe the invention as claimed. Thus, a need exists for a reliable ventilation system capable of being used with a bed, and to avoid the above-mentioned problems.

SUMMARY OF THE INVENTION

The inventor has recognized the aforementioned, inherent problems and lack in the art and observed that there is a need for a device that enables a user to provide a ventilation system capable of being used with a bed. The ventilation system incorporates a blower, a supply tube in fluid communication with the blower, a central supply header in fluid communication with the supply tube, a plurality of distribution branches each in fluid communication with the central supply header, and nozzles for directing the flow of pressurized air from the blower to the environment. The supply tube in certain embodiments is flexible. The central supply header and plurality of distribution branches are adapted to be placed on a bed, typically on top of a mattress underneath the bed linen, such that the nozzles are directed upwards. In a preferred embodiment, the central supply header and plurality of distribution branches are a flattened oblong shape to provide an unobtrusive method of use to a user.

In an embodiment of the present invention, the blower can be powered by an electric motor. The electric motor may or may not be a variable speed motor. In some embodiments, the electric motor is a one to two horsepower (1-2 hp) motor. In a preferred embodiment, the electric motor is in wireless communication with a remote controller.

In another embodiment, located on the flexible tube adjacent the blower is an access cover hingedly attached thereto. The access cover has a release handle on the outside in mechanical communication with a retention clip. The retention clip is configured to retain a scented material therein, capable of being immersed in the flow of air generated by the blower.

In at least one (1) embodiment, a first set of distribution branches extends away from a first side of the central supply header and a second set of distribution branches extends away from a second side of the central supply header.

Furthermore, the features and advantages described herein may be combined in various manners and embodiments as one skilled in the relevant art will recognize. The embodiment and examples disclosed herein can be practiced without one (1) or more of the features and advantages described in a particular embodiment or example.

Further advantages of the embodiments and examples disclosed herein will become apparent from a consideration of the drawings and ensuing description.

BRIEF DESCRIPTION OF THE DRAWINGS

The advantages and features of the embodiments and examples disclosed herein will become better understood with reference to the following more detailed description and claims taken in conjunction with the accompanying drawings, in which like elements are identified with like symbols, and in which:

DESCRIPTIVE KEY

Figure 1:
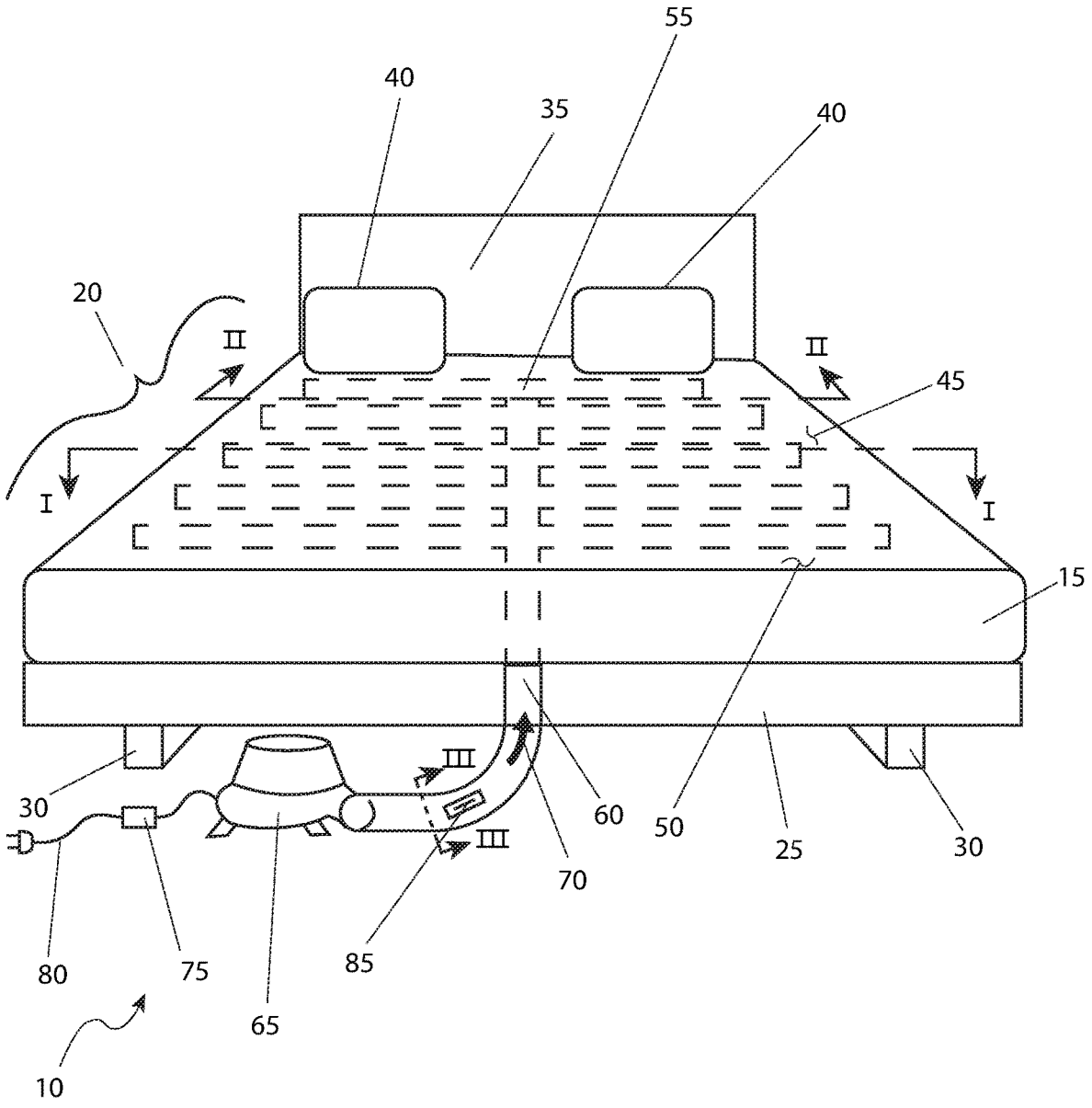
FIG. 1 is an environmental perspective view of the ventilation system for a bed 10, shown in a utilized state, according to the preferred embodiment of the present invention.

10 ventilation system for a bed
15 mattress
20 bed
25 frame
30 support feet
35 head board
40 pillows
45 blankets
50 sheets
55 ventilation assembly
60 flexible supply tube
65 blower motor
70 air flow direction arrow

75 remote control speed controller
80 AC power cord
85 access cover
90 central supply header
95 air distribution branches
100 air nozzles
105 round/oblong coupling
110 individual air flows
115 first travel path
120 hinge
125 fragrance sheet
130 retention clip
135 release handle
140 speed controller
145 wireless receiver
150 wireless transmitter
155 wireless link

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, an environmental perspective view of the ventilation system for a bed 10, shown in a utilized state, according to the preferred embodiment of the present invention front view of the powered ventilation system for a bed 10, according to the preferred embodiment of the present invention is disclosed. The ventilation system for a bed 10 (herein also described as the "system") 10, is used with a mattress 15 as part of a bed 20. The system 10 can be used with a bed 20 of any shape, size or style including but not limited to: residential beds, hospital beds, beds used in commercial structures such as hotels, motels, dormitories, barracks, or the like, or camping beds. It should be noted that the mattress 15 may or may not be used with a box spring. The bed 20 as shown is provided with other common features such as a frame 25, support feet 30, a head board 35, pillows 40, blankets 45, and sheets 50. A ventilation assembly 55 is placed directly atop the mattress 15 and is thus covered by blankets 45 and sheets 50. Due to its hidden state in the present FIGURE, it is depicted by hidden lines. Further description of the ventilation assembly 55 will be provided herein below.

A flexible supply tube 60, approximately three inches (3 in.) in diameter, supplies air to the ventilation assembly 55. The flexible supply tube 60 is routed out of the blankets 45 and sheets 50 at the base of the mattress 15 and is connected to a blower motor 65. The blower motor 65 is of a conventional well-known design. It is electrically powered and utilizes a one to two horsepower (1-2 hp) motor driving a direct connected impellor blade which draws in ambient room air and discharges it at a high rate of speed down the flexible supply tube 60 as depicted by an air flow direction arrow 70. The blower motor 65 receives power from a remote control speed controller 75 powered from a conventional AC power cord 80 as shown. A access cover 85 is provided in the flexible supply tube 60 downstream of the blower motor 65 but upstream of the ventilation assembly 55. This access cover 85 provides for the optional insertion of a fragrance sheet (similar to those used in clothes dryers to freshen clothes). Further description of the design and utilization of the scent sheet access cover 85 will be provided herein below.

Figure 2:
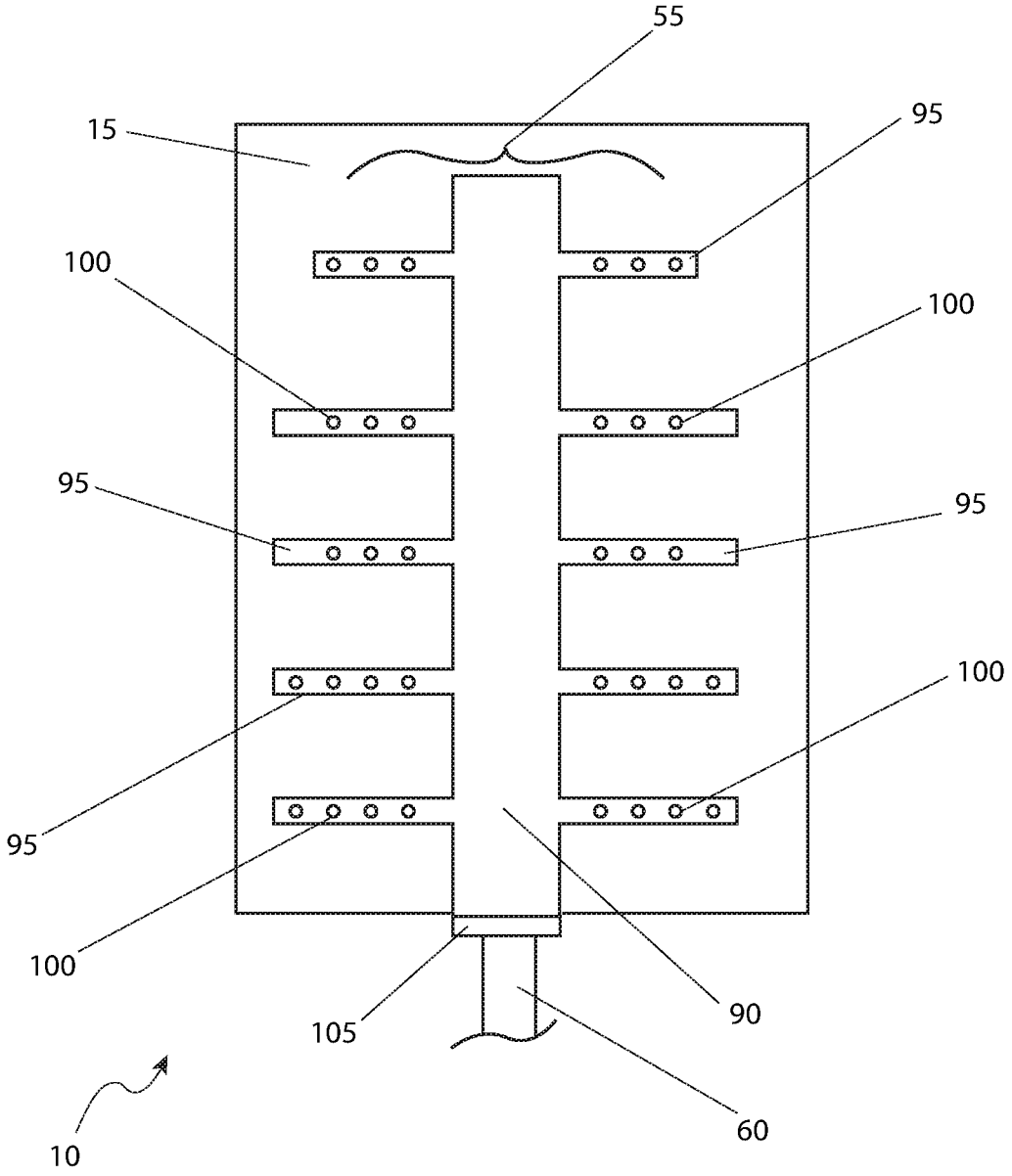
FIG. 2 is a sectional view of the system 10, as seen along a line I-I, as shown in FIG. 1, according to the preferred embodiment of the present invention.

Referring next to FIG. 2, a sectional view of the system 10, as seen along a line I-I, as shown in FIG. 1, according to the preferred embodiment of the present invention is depicted. The ventilation assembly 55 includes a central supply header 90 that is routed down the center longitudinal axis of the mattress 15. Such placement is viewed as especially beneficial for use on mattress 15 sizes such as king and queen which are designed to hold two (2) people. A plurality of air distribution branches 95 are then connected onto the left and right side of the central supply header 90 and terminate at the periphery of the mattress 15. A total of five (5) are shown on each side of the central supply header 90, however, more or less could be used with equal effectiveness, thus the exact quantity of air distribution branches 95 used is not intended to be a limiting factor of the present invention. Each of the air distribution branches 95 are equipped with a plurality of air nozzles 100 which allow the air to exit upwards. The air nozzles 100 are envisioned as relatively large so as to not accelerate the air and avoiding high pressure air and avoiding audible disturbances such as whistling. The nozzles 100 in some embodiments can be mere apertures in the respective air distribution branch 95.

The lower portion of the central supply header 90 is provided with round/oblong coupling 105 to transform from the round shape (i.e., circular cross-section) of the flexible supply tube 60 to the flattened oblong shape (i.e., ovular cross-section) of the central supply header 90. The plurality of distribution branches 95 each also enjoys the same or similar flattened oblong shape as the central supply header 90. In certain embodiments, the central supply header 90 and plurality of distribution branches 95 are a unitary construction. In certain other embodiments, the central supply header 90 and plurality of distribution branches 95 are identical in shape and size and are coupled together.

Figure 3:
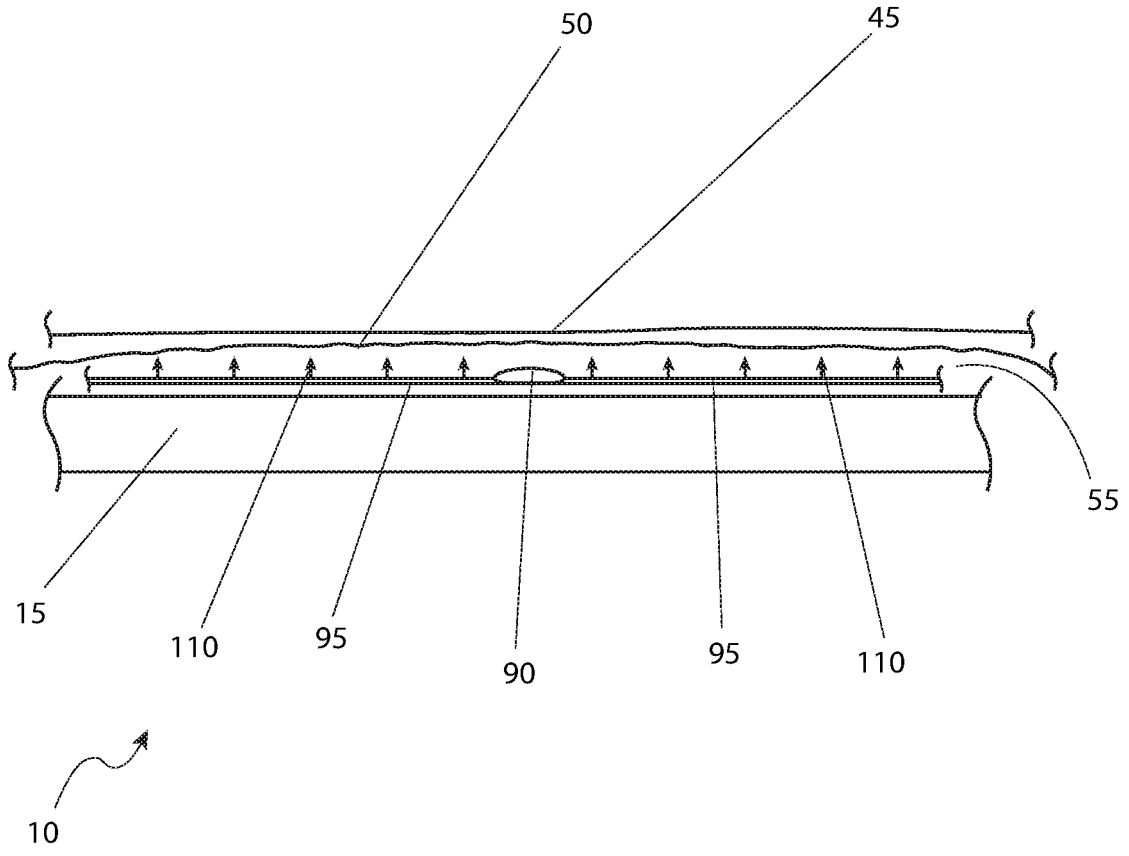
FIG. 3 is a sectional view of the system 10, as seen along a line II-II, as shown in FIG. 1, according to the preferred embodiment of the present invention.

Referring now to FIG. 3, a sectional view of the system 10, as seen along a line II-II, as shown in FIG. 1, according to the preferred embodiment of the present invention is shown. This figure provides teachings of the layered approach of the mattress 15 and its coverings and how the ventilation assembly 55 interfaces in such an environment. During the process of making a bed, the ventilation assembly 55, consisting of the central supply header 90 and air distribution branches 95, is placed directly atop the bare mattress 15. It is arranged as shown in FIG. 2. Next, various bed coverings such as the sheets 50 and the blankets 45 are placed atop in a sequential and normally expected manner Additionally, other coverings such as mattress pads, mattress quilts, top sheets, comforters, and the like may be utilized as well depending on the user's preferences. The use or omission of any specific type of bed covering is not intended to be a limiting factor of the present invention. During utilization of the system 10, air nozzles 100 exit upwards from the air nozzles 100 (not shown in this FIGURE due to illustrative limitations). Said individual air flows 110 result in cooling of the upper bed linens and keep the sleeper comfortable.

Figure 4:
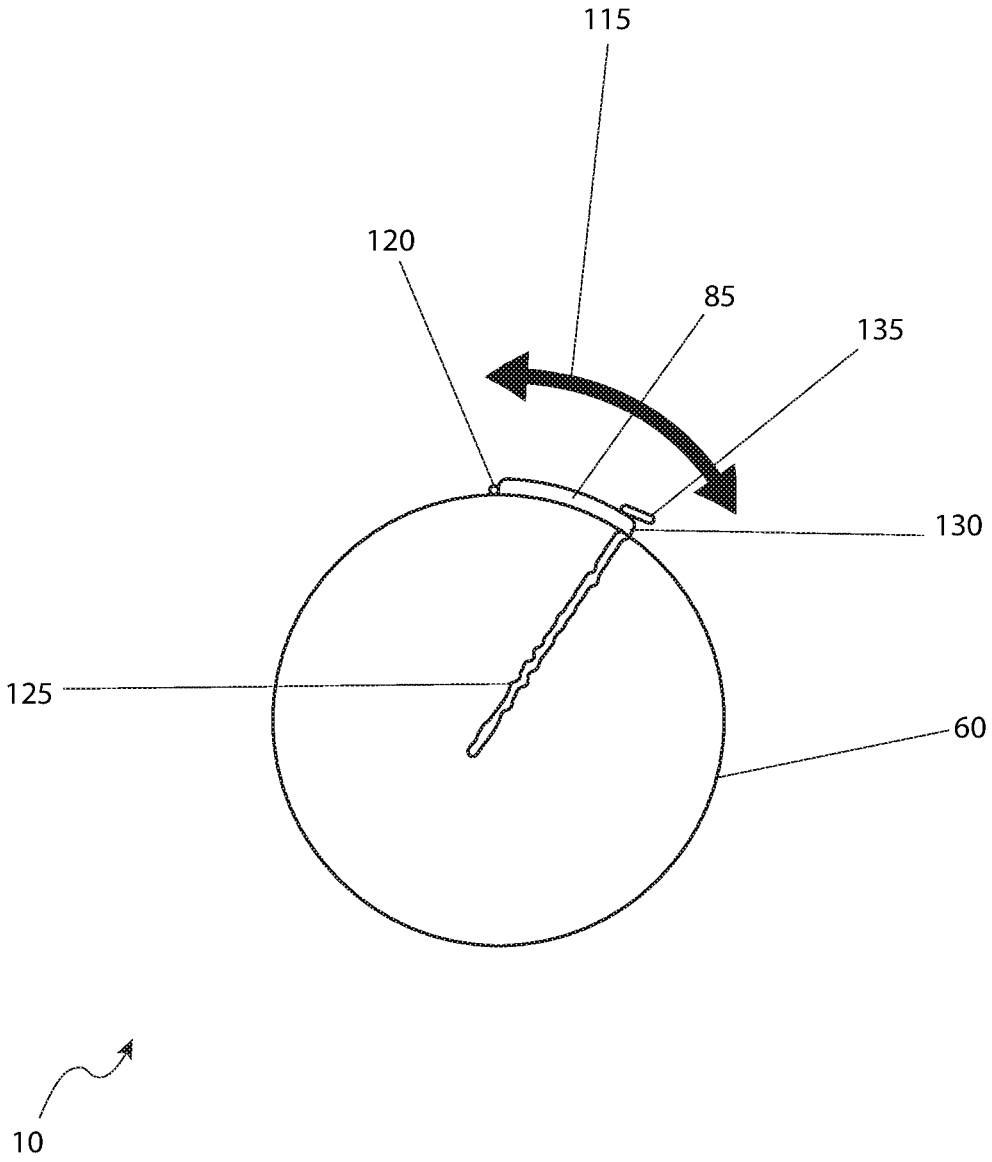
FIG. 4 is a sectional view of the system 10, as seen along a line III-III, as shown in FIG. 1, according to the preferred embodiment of the present invention; and, FIG. 5 is an electrical block diagram of the system 10, according to the preferred embodiment of the present invention.

Referring next to FIG. 4, a system 10, as seen along a line III-III, as shown in FIG. 1, according to the preferred embodiment of the present invention is disclosed. The access cover 85 opens upward along a first travel path 115 as retained by a hinge 120. A fragrance sheet 125, such as a dryer clothes conditioning sheet, is retained over a retention clip 130. It is held captive when the access cover 85 is closed, which fastens a release handle 135 over the retention clip 130 and thus the fragrance sheet 125. The fragrance sheet 125 is allowed to flutter in the path of the passing air (as indicated by the air flow direction arrow 70 in FIG. 1). It is envisioned that the fragrance sheet 125 would be periodically replaced, as often as daily, or as infrequently as during bed sheet changes, depending on the user's preferences. The system 10 may be used without any fragrance sheet 125 and the access cover 85 left in a closed position.

Figure 5:
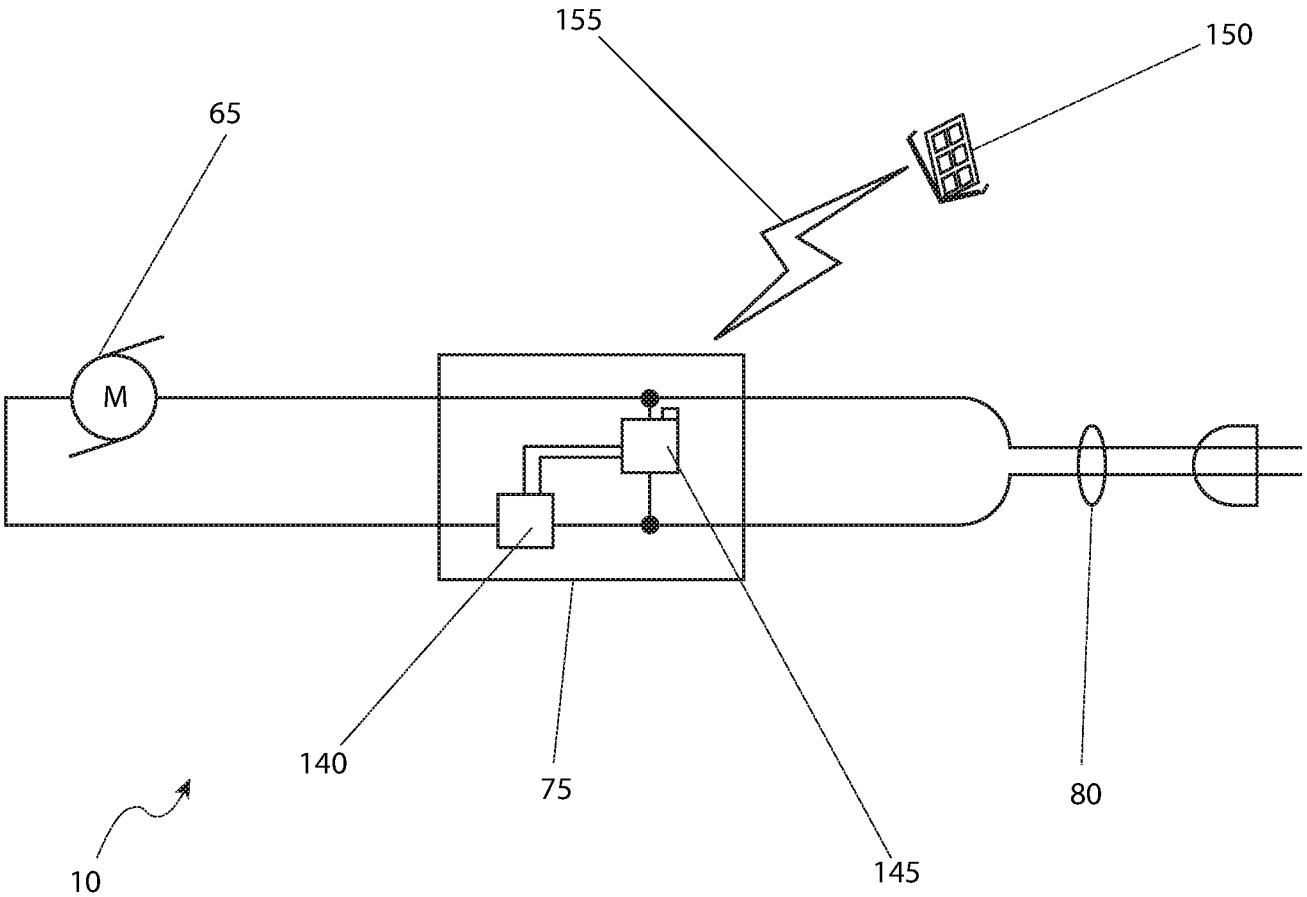

Referring finally to FIG. 5, an electrical block diagram of the system 10, according to the preferred embodiment of the present invention is depicted. AC power is provided by the AC power cord 80 which transports it to the remote control speed controller 75. A speed controller 140 in the remote control speed controller 75 regulates the speed of the blower motor 65 in a "LOW" and "HIGH" arrangement. Control of the speed controller 140 is provided through a wireless receiver 145 which communicates with a wireless transmitter 150 via a wireless link 155 as shown. It is envisioned that the protocol used by the wireless receiver 145, the wireless transmitter 150, and the wireless link 155 could be radio frequency (RF), infrared, optical, audible or the like. It is not the intention of the present invention to limit the wireless protocol used. The wireless transmitter 150 thus provides for "OFF", "LOW" and "HIGH" operation of the system 10 in a cyclic manner Other embodiments can provide for a simple "ON" and "OFF" activation, where the speed of the motor 65 is constant.

The preferred embodiment of the present invention can be utilized by the common user in a simple and effortless manner with little or no training. It is envisioned that the system 10 would be constructed in general accordance with FIG. 1 through FIG. 5. The user would procure the system 10 through normal channels while ensuring that the proper size of system 10 is obtained for the bed upon which it is to be used such as single, double, full, queen, king or any custom sizes or styles as aforementioned described.

After procurement and prior to utilization, the system 10 would be prepared in the following manner: the ventilation assembly 55 would be placed upon a mattress 15, the flexible supply tube 60 would be attached to the central supply header 90 via the round/oblong coupling 105, the opposite end of the flexible supply tube 60 would be attached to the blower motor 65, the AC power cord 80 would be connected to an appropriate power source, and the fragrance sheet 125 would be inserted into the flexible supply tube 60 and secured via the scent sheet access cover 85, finally any bed linens such as blankets 45 and sheets 50 would be applied.

During utilization of the system 10, the following procedure would be initiated: the user selects a desired operating speed (LOW or HIGH) via the wireless transmitter 150, lay down on the bed, and experience the cooling effect of the system 10. In addition to providing a cooling effect, the system 10 aids in the reduction of bed sores, ulcerations, and other abnormalities associated with long periods of bed rest.

After use of the system 10, it is turned off via the wireless transmitter 150 which readies it for use at another time in a cyclical manner. The fragrance sheet 125 is replaced on a periodic basis as needed.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplate.

The invention claimed is:

1. A ventilation system for a bed, comprising:
a blower; and
a ventilation delivery assembly, comprising:
a supply tube having a first end in fluid communication with said blower and a second end;
an access cover hingedly attached to said supply tube adjacent to said blower;
a central supply header having a first end in fluid communication with said supply tube second end;
a plurality of distribution branches each having a first end in fluid communication with said central supply header; and
a nozzle located at a second end of each of said distribution branches;
wherein said central supply header and said distribution branches are placed on a mattress;
wherein said supply tube is flexible;
wherein said central supply header and said distribution branches have an oblong flattened cross-section;
wherein each said nozzle is oriented at an upper position of each said second end of said distribution branches, opposite said mattress when place thereupon;
wherein said access cover further comprises a retention clip in mechanical communication with a release handle, said retention clip retains said scented material;
wherein said blower is powered by an electrical motor;
wherein said electrical motor is a one horsepower motor or a two-horsepower motor; and
further comprising a fragrance sheet retained over said retention clip, said fragrance sheet is held captive when said access cover is closed, which fastens said release handle over said retention clip and said fragrance sheet.

2. The system of claim 1, wherein said electrical motor is in wireless communication with a remote controller.

3. The system of claim 1, wherein said supply tube is three inches in diameter.

4. The system of claim 1, wherein a first set of said distribution branches extend outward from a first side of said central supply header and a second set of said distribution branches extend outward from a second side of said central supply header.

5. A ventilation system for a bed, comprising:
a variable speed blower; and
a ventilation delivery assembly, comprising:
a supply tube having a first end in fluid communication with said blower and a second end;
an access cover hingedly attached to said supply tube adjacent to said blower;
a central supply header having a first end in fluid communication with said supply tube second end;

a plurality of distribution branches each having a first end in fluid communication with said central supply header; and a nozzle located at a second end of each of said distribution branches;

wherein said central supply header and said distribution branches are placed on a mattress;

wherein said supply tube is flexible;

wherein said central supply header and said distribution branches have an oblong flattened cross-section;

wherein each said nozzle is oriented at an upper position of each said second end of said distribution branches, opposite said mattress when place thereupon;

wherein said access cover further comprises a retention clip in mechanical communication with a release handle, said retention clip retains said scented material;

wherein said blower is powered by an electrical motor; and wherein said electrical motor is a one horsepower motor or a two-horsepower motor; and further comprising a fragrance sheet retained over said retention clip, said fragrance sheet is held captive when said access cover is closed, which fastens a release handle over said retention clip and said fragrance sheet.

6. The system of claim 5, wherein said electrical motor is in wireless communication with a remote controller.

7. The system of claim 5, wherein said supply tube is three inches in diameter.

8. The system of claim 5, wherein a first set of said distribution branches extend outward from a first side of said central supply header and a second set of said distribution branches extend outward from a second side of said central supply header.

* * * * *